US006340801B1

(12) United States Patent
Fukuda et al.

(10) Patent No.: US 6,340,801 B1
(45) **Date of Patent: *Jan. 22, 2002**

(54) ROTARY ENCODER AND MULTI-OPERATIONAL ELECTRONIC COMPONENT USING THE SAME

(75) Inventors: Tetsuya Fukuda; Takahiro Nishimura; Jun Sato; Koji Ono; Takumi Nishimoto, all of Okayama; Yukihiro Ishihara; Masaki Sawada, both of Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/713,224

(22) Filed: Nov. 16, 2000

(30) Foreign Application Priority Data

Nov. 19, 1999 (JP) ..... 11-329494

(51) Int. Cl.[7] ..... H01H 25/00
(52) U.S. Cl. ..... 200/18; 200/11 G
(58) Field of Search ..... 200/11 DA, 11 E, 200/11 EA, 11 G, 4, 18, 565

(56) References Cited

U.S. PATENT DOCUMENTS 4,454,396 A * 6/1984 Neese ..... 200/11 G X
4,640,995 A * 2/1987 Naaijer ..... 200/11 DA
4,652,947 A 3/1987 Oka et al.
5,422,448 A 6/1995 Nakano et al.
5,613,600 A * 3/1997 Yokoji et al. ..... 200/565 X
6,211,474 B1 * 4/2001 Takahashi ..... 200/18
6,218,635 B1 * 4/2001 Shigemoto et al. ..... 200/4 X

FOREIGN PATENT DOCUMENTS

| | | | |
|---|---|---|---|
| DE | 4405962 | * | 6/1995 |
| GB | 2260598 | * | 4/1993 |
| JP | 10-312728 | * | 11/1998 |

* cited by examiner

*Primary Examiner*—Renee Luebke
(74) *Attorney, Agent, or Firm*—Wenderoth, Lind & Ponack, L.L.P.

(57) ABSTRACT

The disclosed rotary encoder includes contact substrate 31 and movable contact plate 32. Substrate 31 contains three fan-shaped conductive layers 34A, 34B, and 34C on positions having a same distance from the center of substrate 31. On the other hand, movable contact plate 32 retains three elastic contacts 36A, 36B, 36C, and rotates. The three contacts have continuity with each other and disposed at positions with a same distance from the center of substrate 31, spaced at a radial angle of 120°. When contact plate 32 is rotated, any two out of three elastic contacts 36A, 36B, and 36C consecutively contact with any two out of three conductive layers 34A, 34B, and 34C. Through the continuity, an electric signal is led out from terminals 35A, 35B, and 35C.

11 Claims, 18 Drawing Sheets

ROTARY ENCODER AND MULTI-OPERATIONAL ELECTRONIC COMPONENT USING THE SAME

FIELD OF THE INVENTION

The present invention relates to a rotary encoder that generates a signal detecting the amount of change, i.e. rotational angle in rotation and rotating direction during rotational operation, and multi-operational electronic component, such as a mouse for a PC and a cellular phone, using the rotary encoder.

BACKGROUND OF THE INVENTION

FIG. 14 shows a plan view of the contact portion of a conventional rotational type encoder (hereinafter referred to simply as RTE), which generates an electric signal detecting the amount of change (rotational angle) in rotation and rotating direction during rotational operation. rotational contact plate 1 rotatably mounted on base 5, and three flexible sliding bars 6, 7, 8 extended from base 5.

Rotational contact plate 1 has rotary contact 2 formed typically by insertion molding on the surface of an insulation resin-made circular board. Rotary contact 2 includes common annular contact 3 and teeth-shaped contact 4 for signal generating, with each tooth angled uniformly and extended radially from annular contact 3.

Flexible sliding bars 6, 7, and 8 have elastic contacts 6A, 7A, and 8A on each tip of the bars, respectively.

As shown in FIG. 14, elastic contacts 6A, 7A, and 8A are arranged parallel in a radial direction of rotary contact 2, and contact with rotary contact 2. Elastic contacts 6A contacts with annular contact 3, while elastic contacts 7A, 8A contact with teeth-shaped contact 4. On rotational contact plate 1, the contact spot of elastic contact 7A is displaced from that of contact 8A by "D" (indicated in FIG. 14) in a rotating direction of contact plate 1.

Following the rotating operation of plate 1, contact 6A slides resiliently on annular contact 3, and contacts 7A and 8A slide resiliently on teeth-shaped contact 4. As contact plate 1 rotates, electric signals having a rectangular wave, as shown in FIG. 15, are generated between contacts 6B and 7B, 6B and 8B. In FIG. 15, the rotational angle of plate 1 is described on the horizontal axis. Suppose that an electric signal generated between contacts 6B and 7B is designated as signal "M", while an electric signal generated between contacts 6B and 8B is designated as signal "N". In the prior art, the rotational angle and the rotating direction have been detected according to the number of signals "M" and "N", and the phase difference (i.e., the angle difference) "T" between the two signals.

FIG. 16 shows a general perspective view of a rotary encoder with a push switch (hereinafter referred to simply as REPS), which functions as a multioperational type electronic component employing the RTE described above. FIG. 17 is a cross-sectional side view of the REPS shown in FIG. 16. As shown in FIGS. 16 and 17, RTE 12 is disposed on one side of mounting substrate 11 serving as a base, on the other side of substrate 11, self-restoring type push switch (hereinafter referred to simply as PS) 13 is disposed. RTE 12 is held on substrate 11 in a manner that it is movable in a vertical direction (indicated by arrows "V" in FIGS. 16 and 17.) On the other hand, PS 13 is fixed to substrate 11 so as not to move. FIG. 18 shows a general perspective view of mounting substrate 11.

As shown in FIG. 18, resin-made substrate 11 is provided with:

recess 15 having guide rails 14 for RTE 12 to move along;

recess 16 for fixing PS 13; and three contact plates 18 (18A, 18B, 18C) having their respective three terminals 17 (17A, 17B, 17C) for leading electric signals of RTE 12 to the outside.

As shown in FIG. 17, RTE 12 is held by recess 15 in substrate 11 and guide rails 14 in a manner that it is movable in a vertical direction indicated by the arrow "V".

As described above, RTE 12 comprises:

rotary contact 20A including an annular contact portion, and a teeth-shaped contact portion arranged outside of the annular contact portion, which is mounted on an inner surface of cylindrical operating knob 19; and three flexible sliding bars 22A, 22B, and 22C extended in parallel from resin-made substrate 21.

Operating knob 19 is retained with substrate 11 in a manner that it is rotatable on cylindrical shaft 23. Each elastic contact of three sliding bars 22A, 22B, 22C connects resiliently with rotary contact 20A, having a parallel arrangement in a radial direction of rotary contact 20A.

Furthermore, three elastic contact legs 24 having electrical continuity with their respective elastic contact bars 22A, 22B, 22C, which protrude in an opposite direction from substrate 21, connect resiliently with three contact plates 18 (18A, 18B, 18C).

On the other hand, as shown in FIG. 17, PS 13 is fitted in recess 16 in substrate 11 so as not to move. Actuating button 25 of PS 13 is in contact with pushing portion 23A of cylindrical shaft 23 and pushes it up. Switching terminal 26, which transmits the electric signal from PS 13 to the outside, projects downwardly from substrate 11.

FIG. 19 is a partially sectioned side view depicting an example in which the REPS is mounted in an end-use apparatus. As shown in FIG. 19, leg 11A disposed on the bottom of substrate 11, terminal 17 of RTE 12, and switching terminal 26 of PS 13 are inserted into mounting holes 28 and 29 in wiring board 27 of the apparatus, and soldered. In this way, the REPS is mounted in an apparatus. Periphery 19A of operating knob 19, serving as an operating portion, protrudes from upper enclosure 30 of the apparatus.

The REPS of the prior art constructed as above operates in a manner, which will be described hereinafter.

First, RTE 12 will be described.

An operator rotates cylindrical operating knob 19 by applying a force on periphery 19A of knob 19 in the tangential direction (indicated by the arrow "H" in FIG. 16). This rotary motion causes rotary plate 20 to rotate on cylindrical shaft 23. According to the rotation, each elastic contact of three flexible sliding bars 22A, 22B, 22C slides on contact 20A including annular contact portion and teeth-shaped contact portion secured to rotary plate 20, while maintaining resilient contacts therewith. As a result, RTE 12 generates an electric signal corresponding to the rotating direction of operating knob 19. This electric signal is transferred to contact plate 18 on mounting substrate 11 from three elastic contacts respectively corresponding to three sliding bars 22A, 22B, 22C. The electric signal is further transferred to a circuit on wiring board 27 of the apparatus through terminals 17 for external connections.

Now, the self-restoring PS will be described.

The operator applies a depressing force on periphery 19A of knob 19 in a direction toward the central axis of rotation (i.e., the direction of the arrow "V1" shown in FIG. 19) against the biasing force of actuating button 25 which pushes RTE 12 upward. The depressing force shifts entire RTE 12 in the direction of the arrow "V1" along guide rails 14 of substrate 11. This movement causes pushing portion 23A of cylindrical shaft 23 to depress actuating button 25. The depressed motion of actuating button 25 actuates PS 13 to thereby generate an electric signal. The electric signal is transmitted through switching terminal 26 to the circuit on wiring board 27 in the apparatus. When the depressing force applied on knob 19 is removed thereafter, RTE 12 is pushed back and returns to its original position by a resilient restoring force of PS 13. This is how the REPS of the prior art operates.

However, the RTE of the prior art, as shown in FIGS. 14 and 15, generates two electric signals "M" and "N" for detecting the amount of change (rotational angle) in rotation and rotating direction during rotational operation. For this detection, the prior art has employed the arrangement: three contacts 6A, 7A, 8A of three flexible sliding bars 6, 7, 8 are placed in a parallel direction of rotary contact 2, such that common elastic contact 6A of sliding bar 6 contacts resiliently with annular contact 3, while two signaling elastic contacts 7A and 8A respectively disposed on sliding bars 7 and 8 are in resilient contact with teeth-shaped contact 4 extended from annular contact 3. For this arrangement, the RTE of the prior art inconveniently needs a large diameter of the entire RTE. Consequently, in the REPS functioned as a multi-operational electric component employing the RTE of the prior art, cylindrical operating knob 19 to operate RTE 12 needs to be made even larger in size. Moreover, the top end of mounting substrate 11 must be kept from protruding beyond upper enclosure 30 when mounting the REPS on the apparatus. Furthermore, a wide space is needed between upper enclosure 30 and wiring board 27 due to the structure in which the bottom surface of substrate 11 mounted on wiring board 27 of the apparatus has to be kept lower than the bottom position where knob 19 reaches. Thus, in the prior art, there has been a problem that an enclosure of the apparatus equipped with the REPS becomes so bulky in height size.

SUMMARY OF THE INVENTION

The present invention is intended to eliminate the foregoing problems of the past by realizing an RTE having a small-sized diameter, which generates an electric signal to detect the amount of change in rotation and rotating direction during rotational operation. In addition, with the improved RTE, this invention aims at providing a multi-operational electronic component not only having a cylindrical operating knob with small-sized outer diameter, but also having an enclosure of an end-use apparatus with reduced height.

The rotary type encoder of the invention comprises:

- a contact substrate on which three fan-shaped conductive layers having respective leading terminals are disposed such that they are placed on the positions having a same distance from the center of the substrate; and
- a movable contact plate having three elastic contacts, which have an electrical continuity with each other and are spaced with the radial angle of 120°. The movable contact plate is disposed so as to be rotatable on the center of the contact substrate.

Disposed on the positions having a same distance from the center of the contact substrate, the three elastic contacts resiliently contact with the substrate.

As the movable contact plate rotates, any two out of three elastic contacts have consecutively electrical continuity with any two out of three fan-shaped conductive layers. The continuity signal is led out from each leading terminal.

The three conductive layers on the surface of the contact substrate, each of which has the radial angle of 60°, spaced apart to subtend an angle of 80° at the center of the substrate.

With such a structure, three different electric signals are generated between leading terminals of the three conductive layers when the RTE rotates. According to the generated number of the three signals and the generating order, it is possible to detect the amount of change (i.e. rotational angle) in rotation and rotating direction during rotational operation. The three elastic contacts having resilient contacts with the contact substrate are disposed on the positions having a same distance from the center of the substrate. This arrangement allows the RTE to have a smaller diameter. With such downsized RTE, it is possible to provide a multi-operational electronic component not only having a cylindrical operating knob with small-sized outer diameter, but also having an enclosure of an end-use apparatus with reduced height size.

DESCRIPTION OF THE PREFERRED EMBODIMENTS

First Preferred Embodiment

Figure 1:
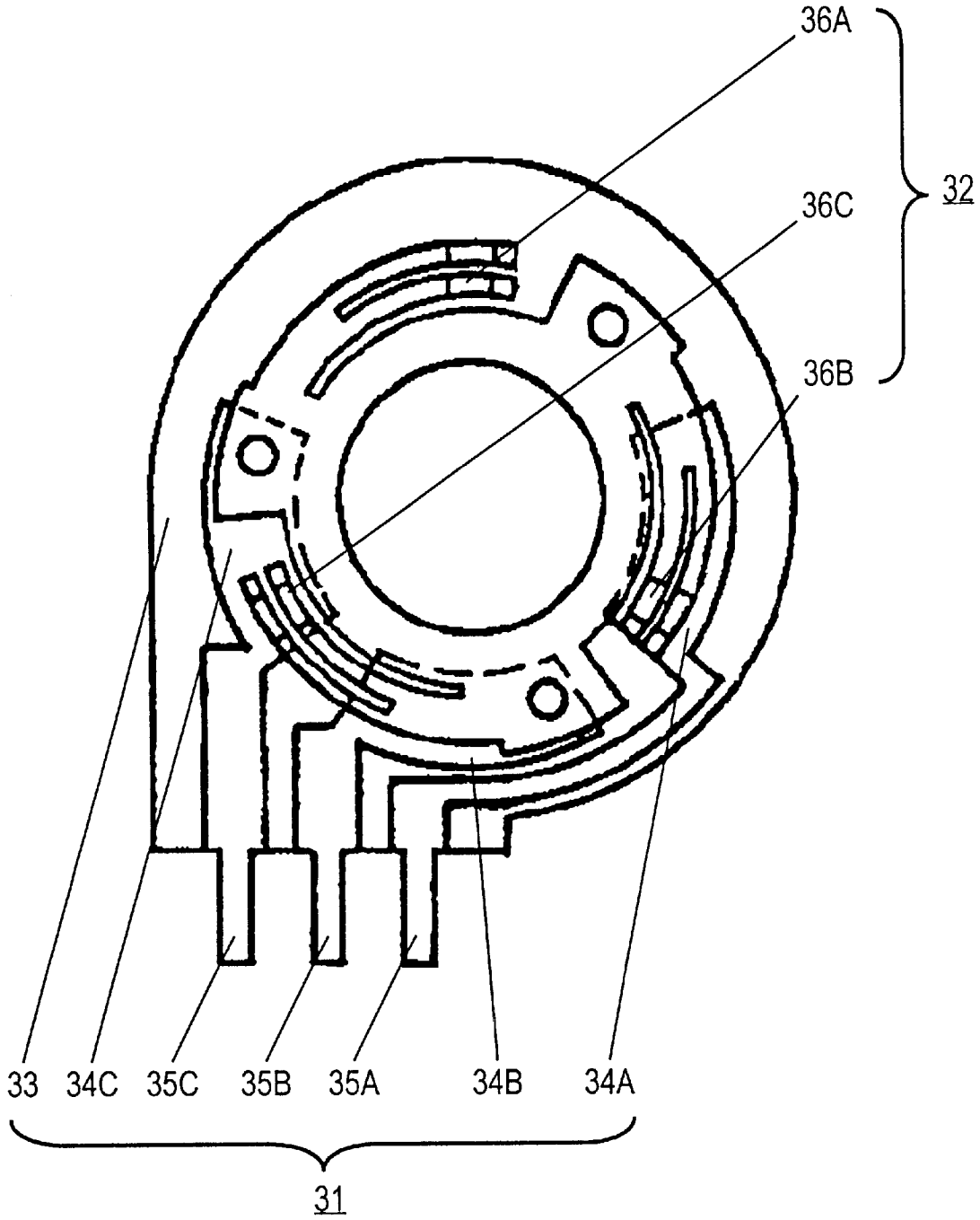
FIG. 1 is a plan view depicting a contact portion of an RTE of a first preferred embodiment of the present invention.

FIG. 1 is a plan view depicting of the contact portion of an RTE in accordance with the first preferred embodiment of the present invention. The contact portion of the RTE shown in FIG. 1 comprises contact substrate 31 holding fixed contacts, and movable contact plate 32 holding movable contacts.

Figure 2:
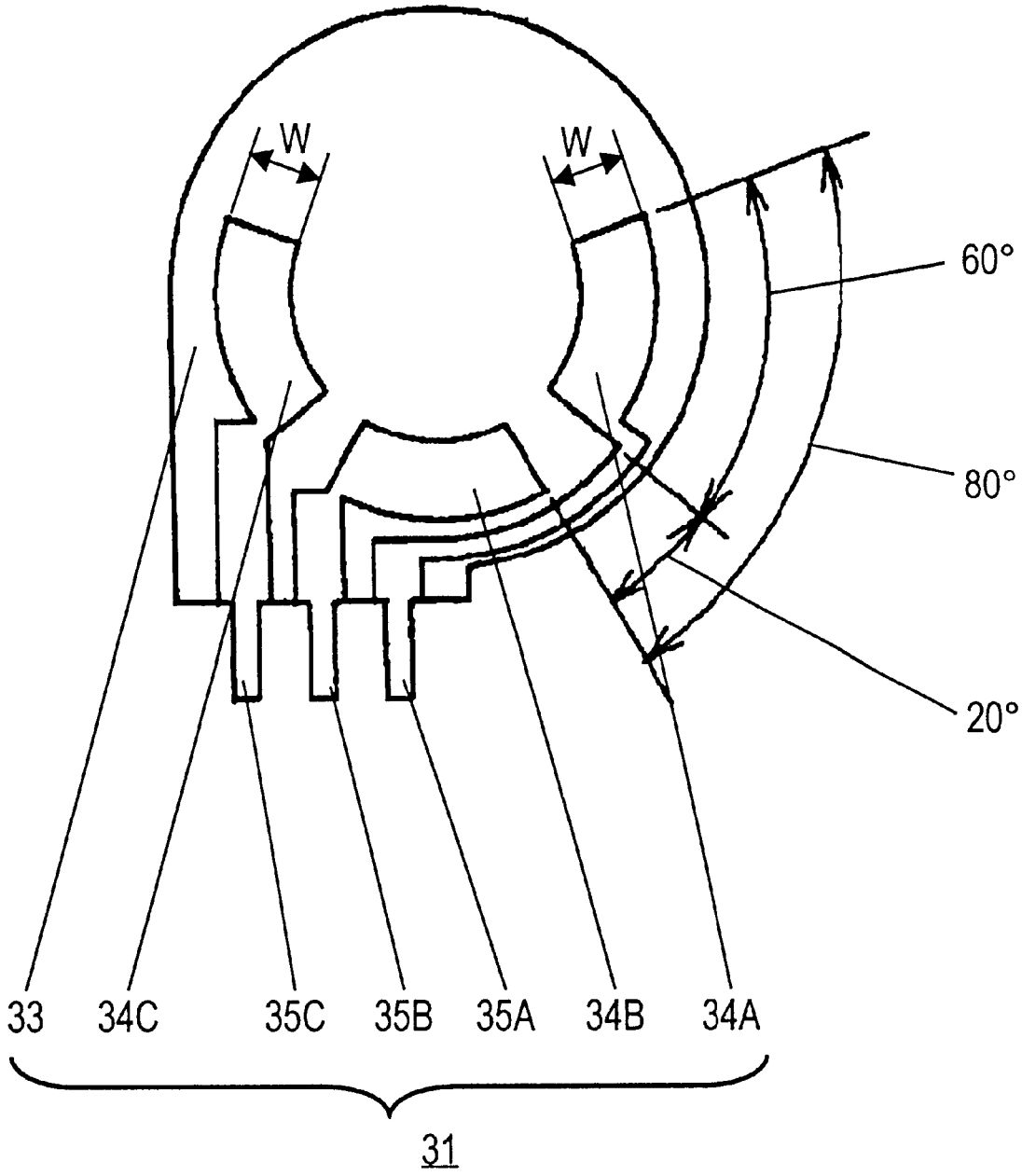
FIG. 2 is a plan view depicting a contact substrate of the RTE shown in FIG. 1.

FIG. 2 is a plan view of contact substrate 31. Contact substrate 31, as shown in FIG. 2, includes roughly circular substrate 33 made of insulation resin, and three fan-shaped conductive layers 34A, 34B, 34C formed on the surface of substrate 33. Three conductive layers 34A, 34B, and 34C are formed from punched thin metal plate, each of which has the radial angle of 60°. As shown in FIG. 2, the conductive layers 34A, 34B, and 34C are formed on substrate 33 by insertion molding, spaced to subtend an angle of 80° at the center of the substrate. Furthermore, the conductive layers 34A, 34B, 34C have first terminal 35A, second terminal 35B, third terminal 35C, respectively.

Figure 3:
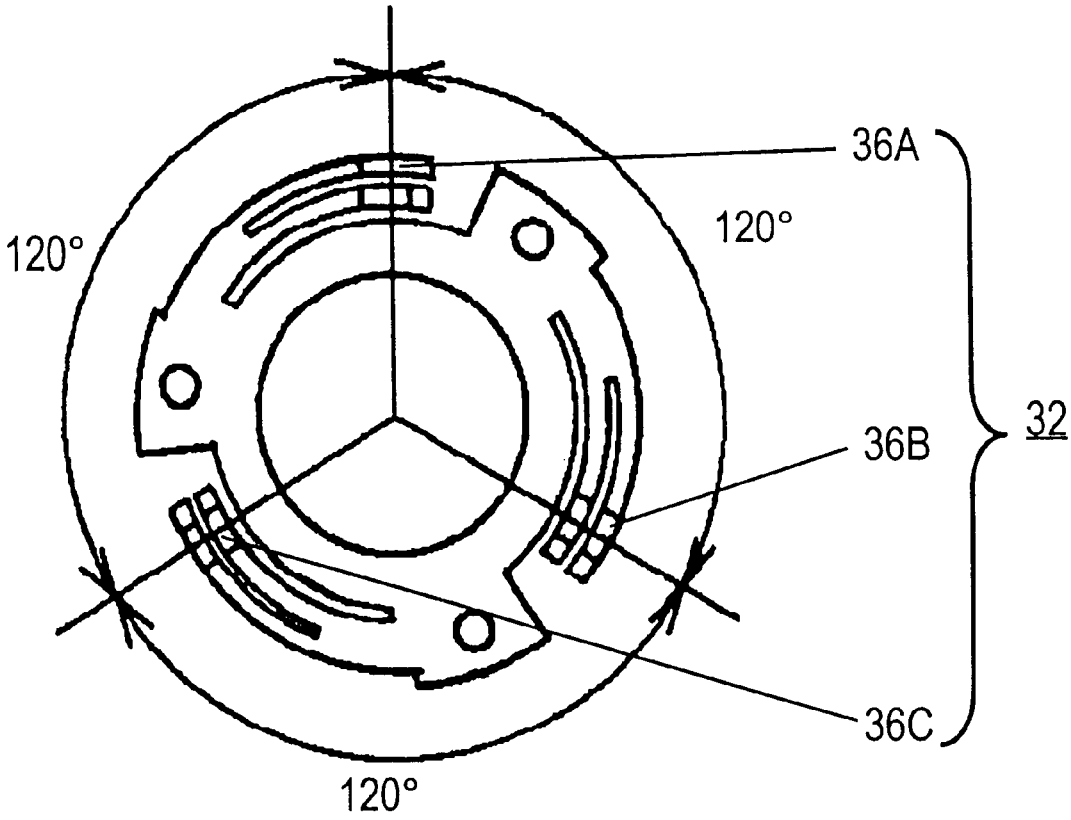
FIG. 3 is a plan view depicting a movable contact plate of the RTE shown in FIG. 1.

Movable contact plate 32 is formed from flexible thin metallic plate processed by punching and bending. As shown in the plan view of FIG. 3, movable contact plate 32 has three elastic contacts 36A, 36B, 36C having an electrical continuity with each other. The three contacts are at a same distance from the center of substrate 33 and are the radial angle of 120° apart from each other.

Figure 4:
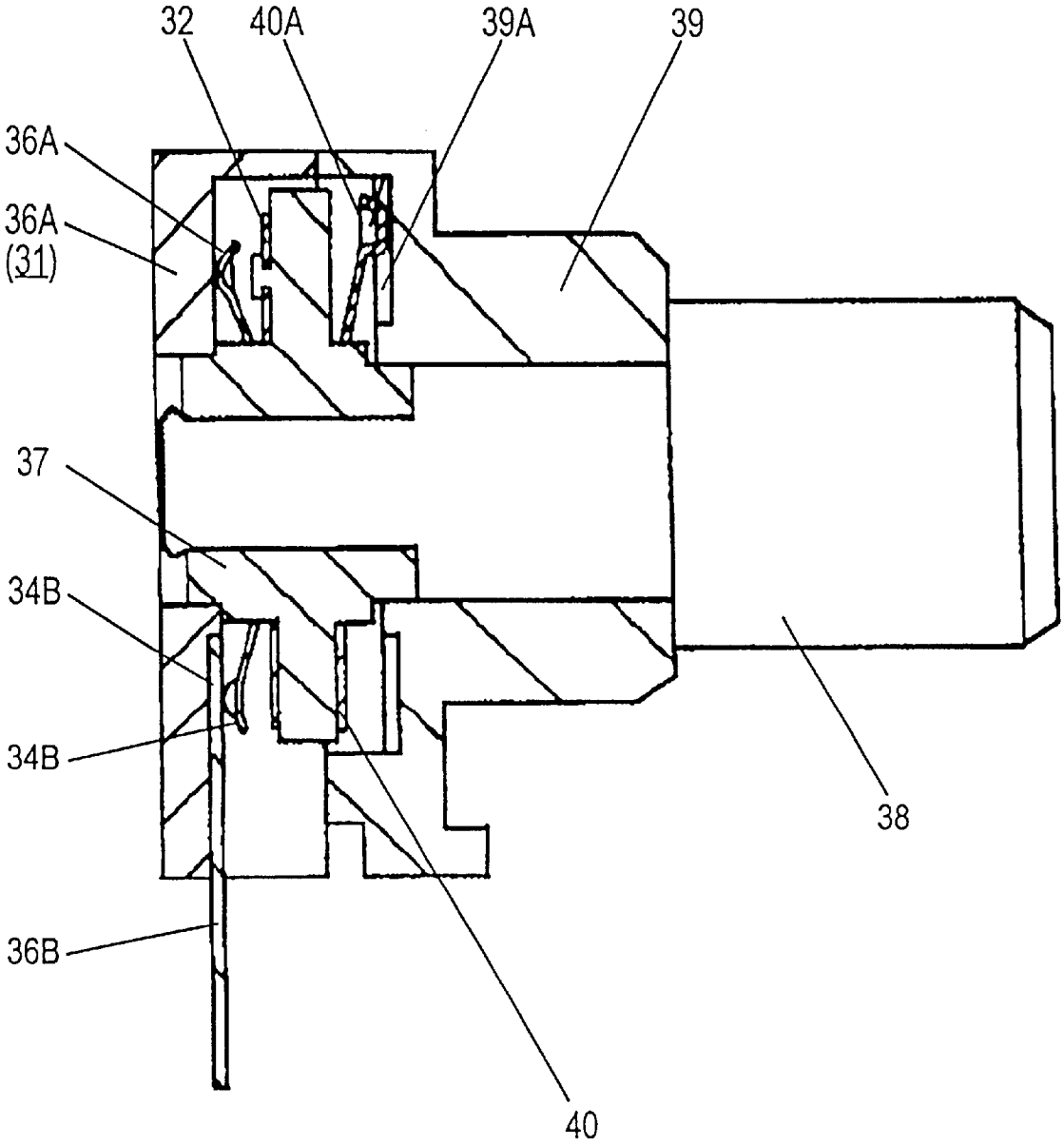
FIG. 4 is a cross-sectional side view of the RTE of the first preferred embodiment of the present invention.

FIG. 4 is a cross-sectional side view of the RTE of the embodiment. As shown in FIG. 4, the RTE has a combined structure of contact substrate 31 and insulation resin-made rotary body 37 holding movable contact plate 32. Rotary body 37 is combined with substrate 31 so as to rotate concentrically to the center of substrate 31. Having such a structure, contact substrate 31 and movable contact plate 32, as shown in FIG. 1, are concentrically combined. When rotary body 37 rotates, three elastic contacts 36A, 36B, 36C slide on three conductive 25 layers 34A, 34B, 34C, while maintaining resilient contacts with the middle position of the widths of three elastic contacts (indicated by the width "W" in FIG. 2) in a radial direction.

The elastic contacts 36A, 36B, and 36C have respectively two flexible legs and contacts. This arrangement aims to obtain a constant steady contact between the elastic contacts and the contact position, i.e., the middle position of the width "W" on the conductive layers. Three elastic contacts 36A, 36B, and 36C also can have another arrangement that they have respectively one leg and contact. In this case, both diameters of contact substrate 31 and movable contact plate 32 can be reduced.

In FIG. 4, bearing 39 retains operation shaft 38 for rotating rotary body 37. In addition, radially undulated portion 39A is formed on the root surface of bearing 39. Positioning indentations are disposed at 40° intervals in radially undulated portion 39A. Flexible thin metal plate-made spring 40 has projection 40A. Flexible spring 40 is retained by rotary body 37 such that projection 40A is kept in resilient contact with radially undulated portion 39A. This structure provides a click feel (tactile response) when operation shaft 39 is rotated. Each time operation shaft 38 stops rotating, projection 40A rests in an indentation of radially undulated portion 39A. That is, movable contact plate 32 retained by rotary body 37 stops at the position corresponding to an indentation (hereinafter referred to as a click position) of undulated portion 39A disposed at 40° intervals on the root surface of bearing 39. As described above, the rotary type encoder of the embodiment has a click mechanism, a rotation can be stopped at a click position.

The RTE of the embodiment constructed as described above operates in a manner, which will be described hereinafter.

Figure 5A:
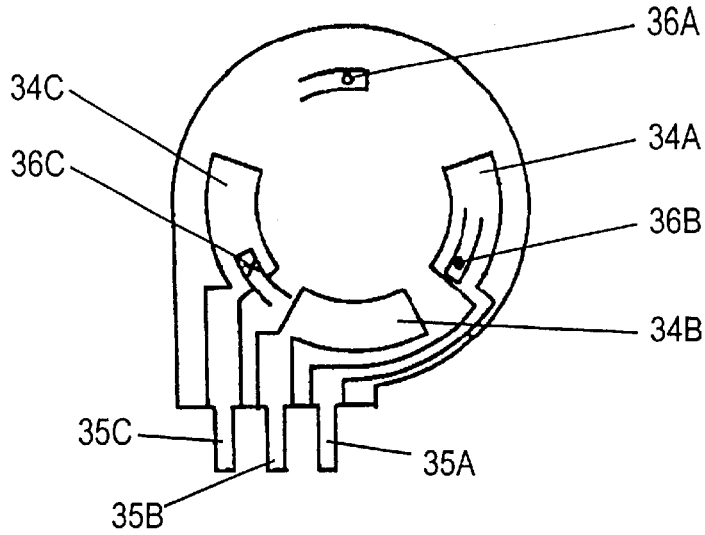
FIGS. 5A through 5C are conceptual views indicative of the state of the contact portion when the RTE shown in FIG. 1 rotates.
Figure 5B:
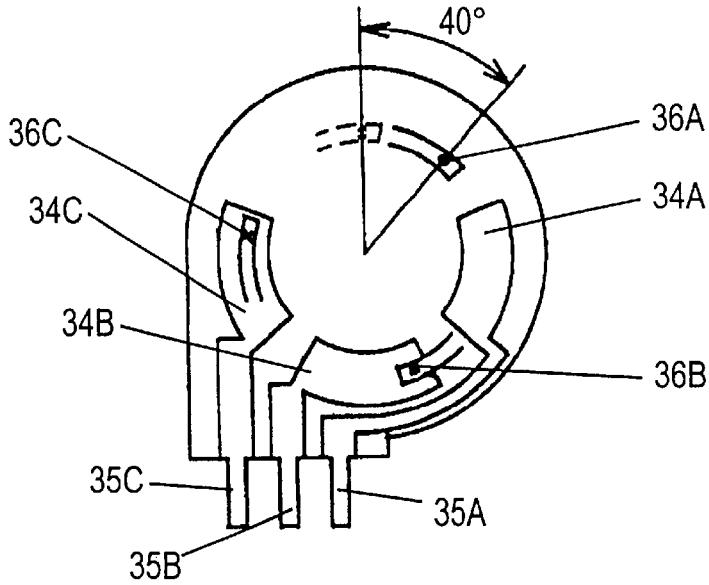
Figure 5C:
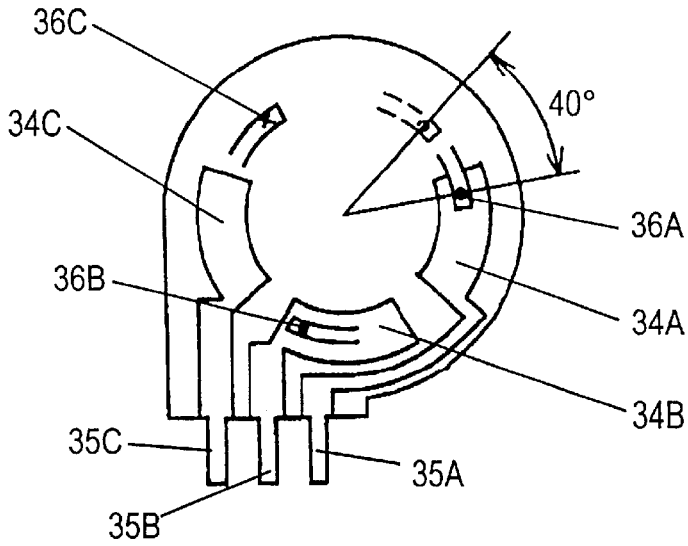
Figure 6:
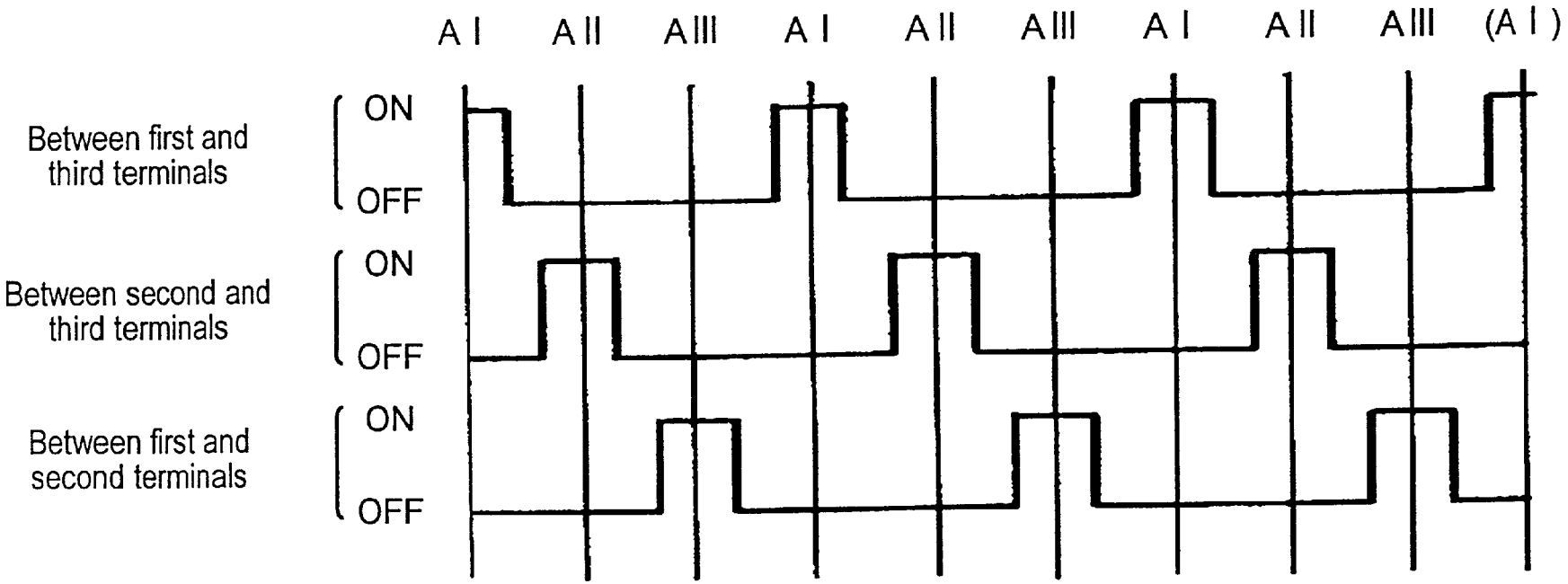
FIG. 6 illustrates waveforms of electric signals generated from the RTE shown in FIG. 4.

FIGS. 5A, 5B, 5C are conceptual views indicative of the state of the contact portion when the RTE rotates. In the interests of simplicity, the flexible legs and contacts shown in FIGS. 5A, 5B, 5C are illustrated, taking a state as an example. FIG. 6 shows the waveforms of electric signals. In FIG. 6, the rotational angle is described on the horizontal axis.

FIG. 5A shows that projection 40A of flexible spring 40 settles into a click position in radially undulated portion 39A and thereby rotary body 37 stops.

FIG. 5A shows the states of each portion of movable contact plate 32. In FIG. 5A, elastic contact 36A (indicated by ○) is on the insulating portion (i.e., substrate 33), contact 36B (indicated by ●) contacts with layer 34A, and contact 36C (indicated by X) contacts with layer 34C. With such a state, conductive layers 34A and 34C are conducting through movable contact plate 32. The electric signal is led out from first terminal 35A and third terminal 35C. The continuity/non-continuity state in this case is indicated at AI (angle I ) in FIG. 6. In the state of AI, first and third terminals 35A, 35C are conducting, while between second and third terminals, i.e., 35B–35C, and between first and second terminals, i.e., 35A–35B, have no continuity.

Suppose that operation shaft 38 is rotated clockwise from the state. FIG. 5B shows the state in which rotary body 37 has been rotated by 40° in a clockwise direction from the state shown in FIG. 5A. By the rotation, projection 40A of flexible spring 40 is settled, accompanying a click feel, into the next click position in radially undulated portion 39A. In the state, elastic contact 36A of movable contact plate 32 is still on the insulating portion (substrate 33), elastic contact 36C maintains contact with conductive layer 34C. Elastic contact 36B, however, contacts with conductive layer 34B, leaving from conductive layer 34A. Therefore, continuity is established between layers 34C and 34B, and its electric signal is led out from third terminal 35C and second terminal 35B. On the other hand, there is no longer continuity between layers 34A and 34C due to the movement of elastic contact 36B. The continuity signal in this case is indicated at AII in FIG. 6. In the state of AII, second and third terminals 35B, 35C are conducting, while between first and third terminals, i.e., 35A–35C, and between first and second terminals, i.e., 35A–35B, have no continuity.

In FIG. 5C, rotary body 37 is rotated by another 40° from the state shown in FIG. 5B. In this state, elastic contacts 36A and 36B bring continuity between layers 34A and 34B. The electric signal led out from first terminal 35A and second terminal 35B. On the other hand, there is no longer continuity between layers 34B and 34C. The continuity signal in this case is indicated at AIII shown in FIG. 6. In the state of AIII, first and second terminals 35A, 35B are conducting, while between first and third terminals, i.e., 35A–35C, and between second and third terminals, i.e., 35B–35C, have no continuity.

In this way, as rotary body 37 is rotated clockwise, three elastic contacts (36A, 36B, 36C) of movable contact plate 32, at 40° intervals, repeat the states of continuity illustrated in FIGS. 5A, 5B, 5C in a round-robin fashion. As a result, rotation of rotary body 37 generates the electric signal shown in FIG. 6. For example, in one complete rotation of rotary body 37, 35A–35C experiences the continuity state and the non-continuity state three times each. Likewise, 35B–35C, 35A–35B experience the two states three times each.

As rotary body 37 rotates, the electric signals below are generated.

1) The continuity/non-continuity states between first terminal 35A and third terminal 35C;
2) The continuity/non-continuity states between second terminal 35B and third terminal 35C; and
3) The continuity/non-continuity states between first terminal 35A and second terminal 35B.

Rotating rotary body 37 generates the signals in which the two states are regularly repeated with respect to each pair of the terminals. The patterns of each signal's waveform are out of phase with each other by 40° corresponding to the rotational angle of rotary body 37.

As described above, the RTE of the embodiment has a click mechanism. The click mechanism allows rotary body 37 to stop without failure at a position having a radial angle when rotating. It is apparent from the stop positions of rotary body 37 in FIGS. 5A to 5C, that the RTE of the embodiment generates an electric signal by making any two out of three elastic contacts 36A, 36B, 36C resilient contact with two conductive layers.

In the explanation above, rotary body 37 is rotated in a clockwise direction. In this case, the pattern of the obtained continuity signal follows the order of AI–AII–AIII shown in FIG. 6 in a round-robin fashion. On the other hand, when rotary body 37 is rotated in a counterclockwise direction, the signal shows the pattern following the reversed order, that is, AIII–AII–AI shown in FIG. 6 in a round-robin fashion.

On the basis of the generating order of three different electric signals during rotational operation, the control section of the end-use apparatus employing the RTE of the embodiment can detect the amount of change (rotational angle) in rotation and rotating direction.

Furthermore, in the RTE of the embodiment, three elastic contacts 36A, 36B, and 36C of movable contact plate 32, all of which have resilient contact with substrate 31, are disposed at a same distance from the center of substrate 31. Such an arrangement allows the diameter of the RTE to be reduced.

As shown in FIG. 2, three conductive layers 34A, 35B, 35C having a radial angle of 60° are spaced at 80° intervals on substrate 31. Therefore, 20° is the angle of the insulation section between conductive layers 34A and 34B, and between 34C.

In the state shown in FIG. 5C, for example, elastic contact 36A contacts with conductive layer 34A. When rotary body 37 is rotated from the position by 40° in a clockwise direction and reaches the next click position, elastic contact 36A still remains to contact with layer 34A. When rotary body 37 is rotated from this position by another 40° then reaches the next click position, elastic contact 36A now contacts with layer 34B. Therefore, It is acceptable if the radial angle of conductive layer 34A is at least greater than 40° and less than 80°. The same goes for conductive layers 34B and 34C, that is, it is acceptable if the two layers have the same radial angle with layer 34A.

However, when elastic contacts 36A, 36B, and 36C contact with conductive layers 34A, 34B, and 34C, each contact point of the three contacts has a length that is not negligible. Taking the length into account, the angle in which each of elastic contacts (36A, 36B, 36C) is into the OFF state on the insulation section of substrate 31 is decreased by the length contacting with substrate 31. Furthermore, the length tends to be generally increased with use due to a wearing in rotating.

Therefore, given an optimum positional adjustment to conductive layers on substrate 31, the elastic contacts on movable contact plate 32, and the click positions, it would be acceptable if each radial angle of conductive layers (34A, 34B, 34C) is at least greater than 40° and less than 80°, preferably greater than 45° and less than 75°.

In the explanation above, three elastic contacts 36A, 36B, and 36C are disposed such that they contact with the position having a same distance from the center of substrate 31 and resiliently slide on a same circle during rotation. In this arrangement, The contact positions followed by three elastic contacts (36A, 36B, and 36C) on substrate 31 may be slightly shifted (approx. 0.1–0.2 mm) in the radial direction. The slight shift of the contact position can minimizes deterioration of three conductive layers 34A, 34B, 34C, and isolation section on substrate 31 due to wearing by sliding, thereby the longevity of the RTE will be improved.

Second Preferred Embodiment

Figure 7:
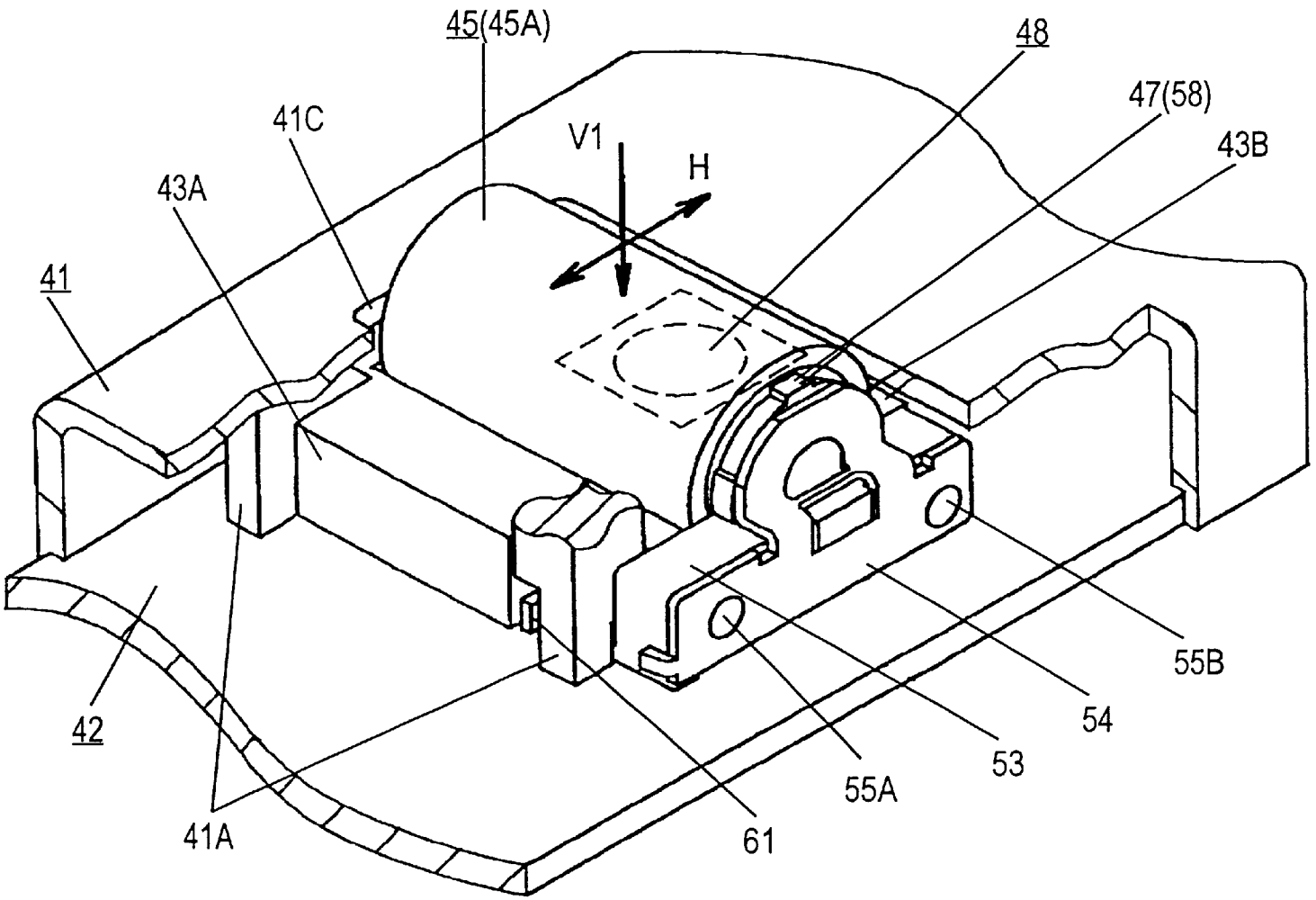
FIG. 7 is a general perspective view, partially in section, of the REPS functioned as a multi-operational electronic component of a second preferred embodiment of the present invention.
Figure 8:
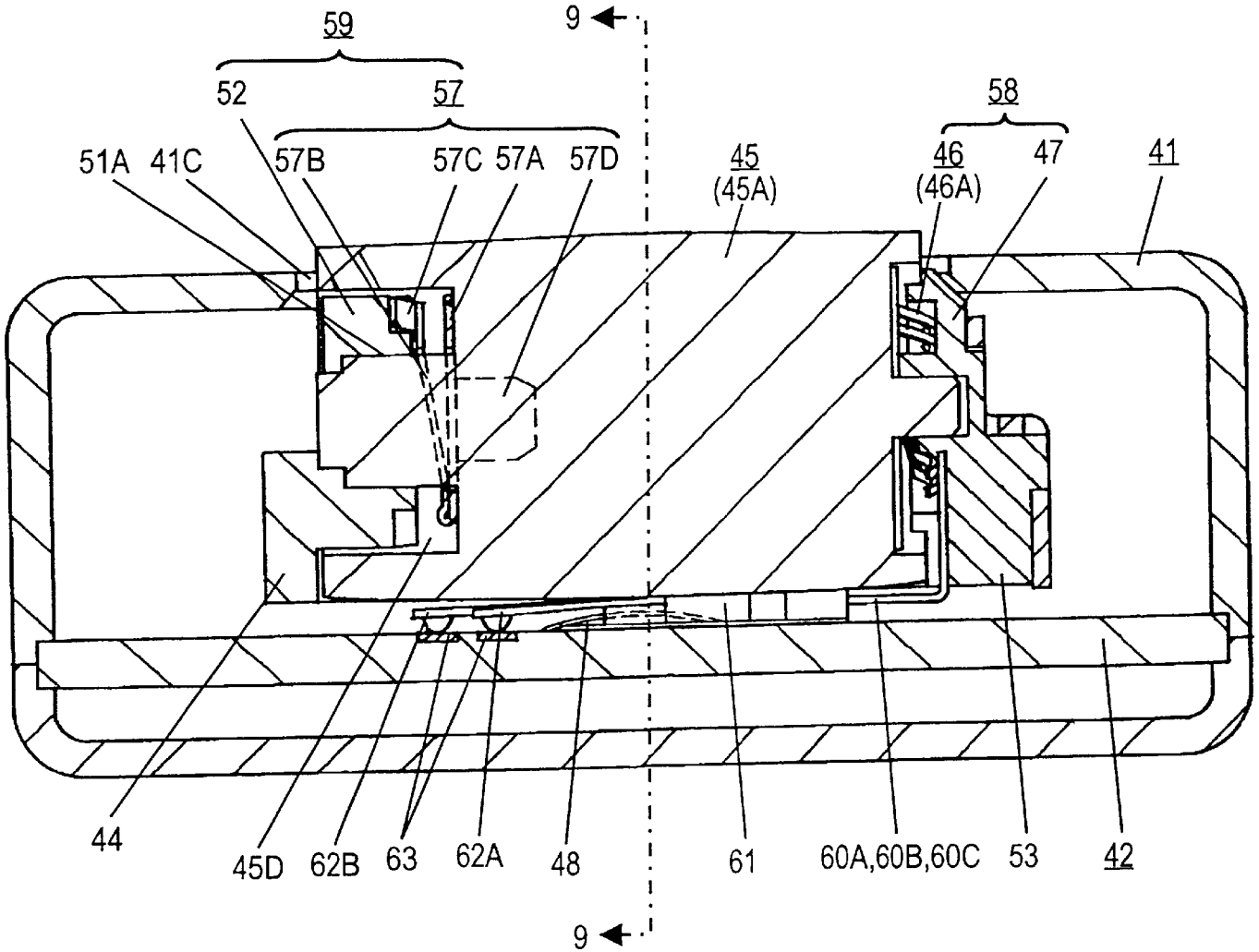
FIG. 8 is a cross-sectional front view of the RTE shown in FIG. 7.
Figure 9:
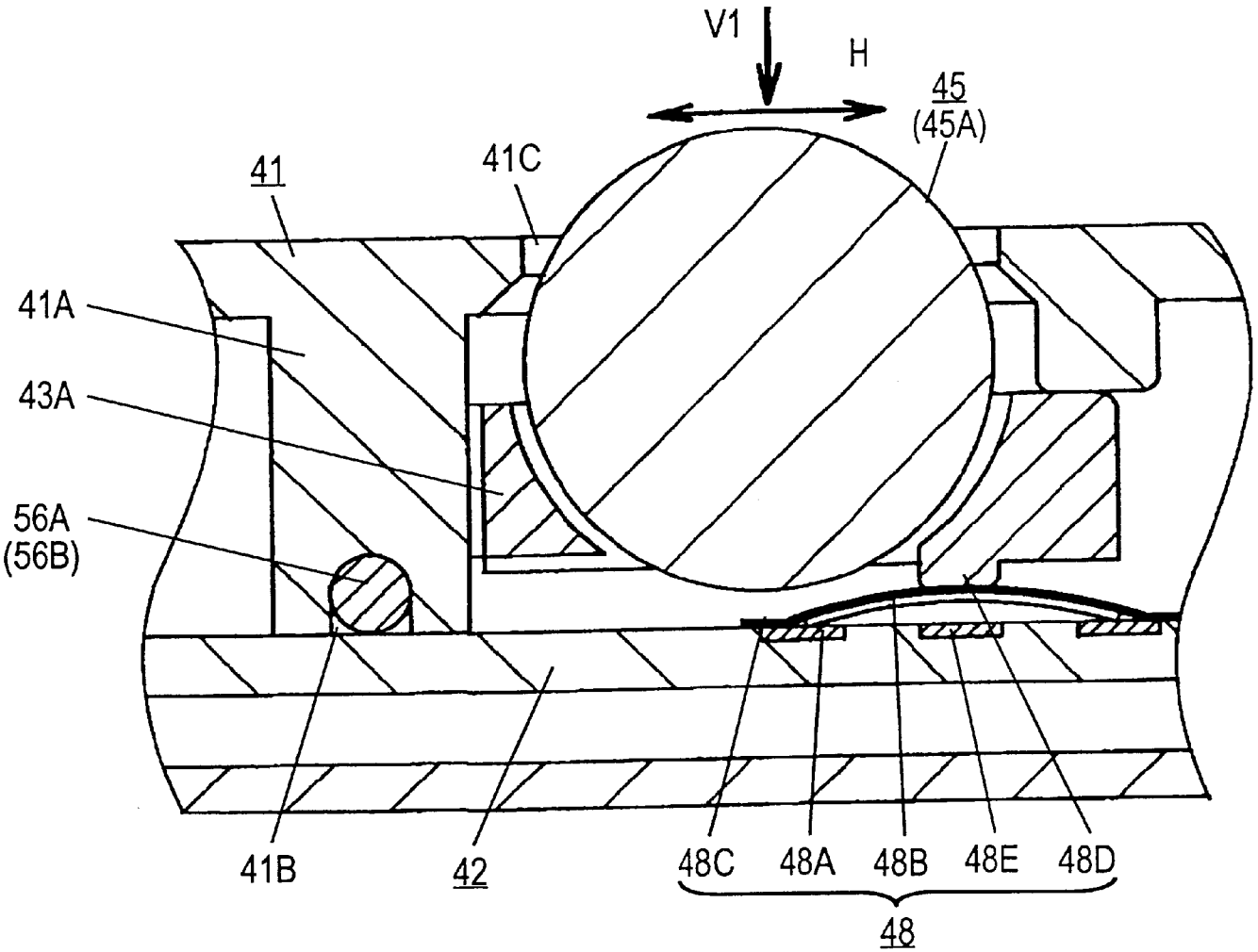
FIG. 9 is a sectional view taken along a line 9—9 in FIG. 8.
Figure 10:
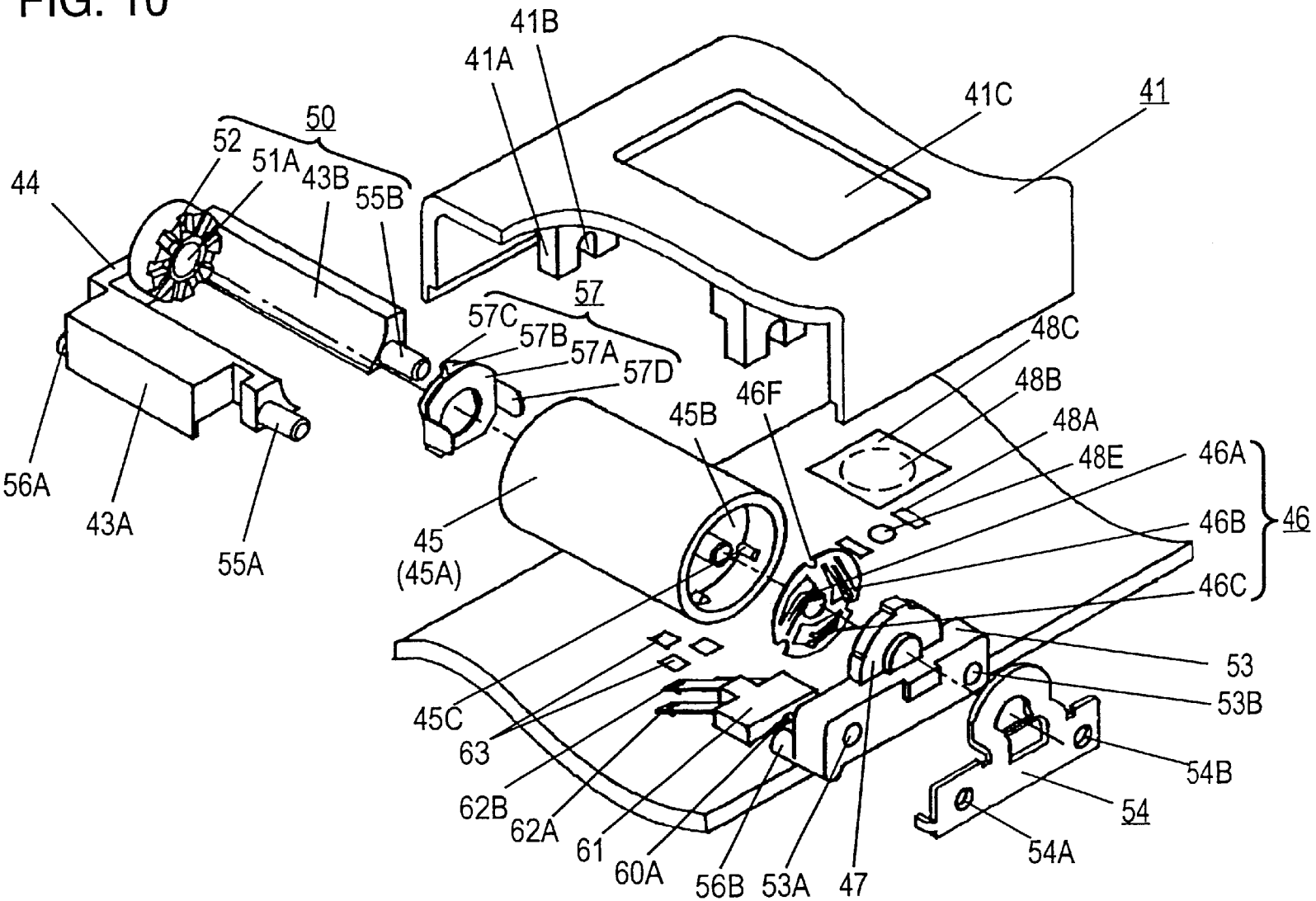
FIG. 10 is an exploded perspective view of the RTE shown in FIG.7.

FIG. 7 is a general perspective view, partially in section, of the rotary encoder with push switch (REPS) functioned as a multi-operational electronic component of the embodiment. In FIG. 7, the REPS is incorporated in an end-use apparatus. FIG. 8 is a cross-sectional front view of the REPS shown in FIG. 7. FIG. 9 is a sectional view taken along a line 9—9 in FIG. 8. FIG. 10 is an exploded perspective view of the REPS shown in FIG. 7.

The REPS of the embodiment including the RTE and the PS is held by wiring board 42 and holder 41A that is disposed on upper enclosure 41 of an end-use apparatus.

The RTE employed for the REPS of the embodiment has quadrangular frame 43 having side 43A which functions as a support axle for frame 43. Holder 4A, as shown in FIG. 7, rotatably retains side 43A supporting frame 43. With the structure, the RTF is rotatably retained between holder 41A and wiring board 42. Frame 43 rotatably retains rotary body 45. Periphery 45A of rotary body 45, which functions as the operation section, protrudes from opening 41C of upper enclosure 41. In addition, rotary body 45 has movable contact plate 46 having three elastic contacts 46A, 46B, and 46C on its one end. Contact substrate 47 having three fan-shaped conductive layers 47A, 47B, and 47C is formed on side 53 of frame 43 facing to movable contact plate 46. Plate 46 and substrate 47 are concentrically combined. The RTE employed for the REPS of the present embodiment are structured as described above.

Furthermore, self-restoring PS 48 is disposed on wiring board 42, which lies under side 43B facing to side 43A of frame 43.

As described above, the REPS of the embodiment comprises the RTE and PS 48. With the structure, it makes possible to reduce the diameter of rotary body 45 serving as the operating knob, thereby the enclosure for the apparatus employing the REPS can be reduced in height.

Now will be described each element structuring the REPS of the embodiment, referring to FIGS. 7 through 10.

Frame 43 comprises:

Insulation resin-made U-shaped section 50 including side 43A functioning as a support axle when rotating, side 43B facing to section 43A, and side section 44 connecting sections 43A and 43B;

Side 53 bridging an open end of U-shaped section 50; and

Reinforcing hardware 54.

Side 44 has retaining hole 51A for rotary body 45 and radially undulated portion 52. Side 53 has retaining hole 51B for rotary body 45 and contact substrate 47 (see FIG. 8).

As for forming frame 43:

Boss 55A at the tip of side 43A is inserted into hole 53A of side 53 and hole 54A of reinforcing hardware 54, then fixed with thermal caulking. Similarly, boss 55B at the tip of side section 43B is inserted into hole 53B of side 53 and hole 54B of reinforcing hardware 54, then fixed with thermal caulking.

Furthermore, cylindrical holder 56A protrudes from one end of side 43A, while cylindrical holder 56B protrudes from side 53. Two holders 56A and 56B are disposed on a same axis. Holders 56A and 56B are sandwiched between wiring board 42 and U-shaped grooves 41B respectively formed at each tip of holders 41A disposed on upper enclosure 41 of the end-use apparatus. With the sandwiched arrangement, as shown in FIGS. 7 and 9, the RTE is retained between upper enclosure 41 of the apparatus and wiring board 42. The clearance between holder 56A (56B) and groove 41B has an enough room for holder 56A (56B) to rotate, so that holder 56A (56B) hardly move in a vertical direction.

Rotary body 45 is rotatably held by retaining holes 51A and 51B that are disposed in frame 43 so as to be faced each other. Periphery 45A of rotary body 45 functions as the cylindrical operation knob for the REPS of the embodiment. Rotary body 45 holds, as shown in FIGS. 8 and 10, movable contact plate 46 made of flexible thin metal in one recess 45B, and spring 57 made of flexible thin metal is held in other recess 45D. Movable contact plate 46 and spring 57 are held so as to be rotatable together with rotary body 45.

Figure 11:
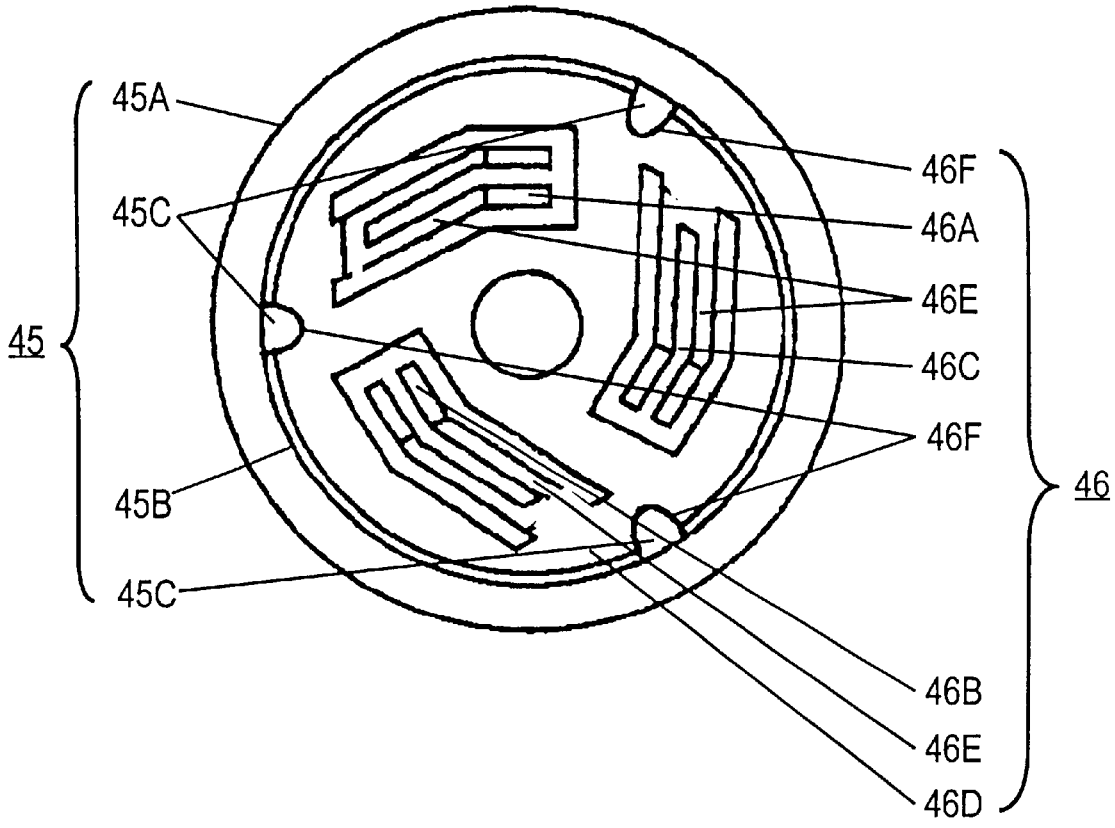
FIG. 11 is a side view of the rotary body indicative of how the movable contact plate is held in the RTE shown in FIG. 7.

Movable contact plate 46 will now be described, referring to FIGS. 10 and 11. FIG. 11 is a side view of the rotary body to which movable contact plate 46 is attached. Movable contact plate 46 is formed in such a way that three flexible legs 46E, which are identically shaped, are popped-up from circular flat plate 46D to the positions, having the radial angle of 120° and same distance from the center of circular plate 46D. Three flexible legs 46E have elastic contacts 46A, 46B, and 46C on each tip of them. There is a gap between the periphery of circular plate 46 and the inner periphery of recess 45B of rotary body 45. Three U-shaped cuts 46F are disposed close to other base section of each flexible leg 46E on the periphery of circular plate 46D. Three projections 45C disposed on the inner periphery of recess 45B are press-inserted into the three cuts 46F. This structure allows movable contact plate 46 to be connected securely with rotary body 45 without deformation or rattling, in spite of a smaller sized periphery of plate 46D.

Although flat plate 46D is formed in a circular shape in the explanation above, it is also effective to be formed in a regular polygon.

Recess 45B of rotary body 45, as shown in FIG. 8, faces to contact substrate 47 disposed on side 53 of frame 43. Three elastic contacts 46A, 46B, and 46C of movable contact plate 46 have a resilient contact with substrate 47, structuring encoder 58 that generates an electric signal when rotary body 45 rotates.

Like contact substrate 31 of the first preferred embodiment, three fan-shaped conductive layers (47A, 47B, 47C) made of thin metal plate are disposed on the surface of substrate 47. The conductive layers are formed from punched thin metal plate, each of which has the radial angle of 60°. And they are formed on substrate 47 by insertion molding, disposed on the positions having a same distance from the center of the substrate, keeping 80° intervals with respect to the center of the substrate.

Flexible projection 57C of spring 57 is, as shown in FIG. 10, formed at the top of flexible arm 57B that is extended from flat section 57A. On the opposite side of flexible arm 57B of flat section 57A, two tabs 57D are extended from flat section 57A. Two tabs 57D are press-inserted into two holes (not shown) in recess 45D of rotary body 45, allowing spring 57 to connect with rotary body without rattling. As shown in FIG. 8, side 44 facing to recess 45D of rotary body 45 has radially undulated portion 52, in which the indents are disposed at 40° intervals. Projection 57C of spring 57 has a resilient contact with one of the indent of radially undulated portion 5. Such structured encoder 58 produces a click feeling when rotary body 45 is rotated. When rotary body 45 stops, flexible projection 57C settles into an indent of radially undulated portion 52. Therefore, movable contact plate 46 retained by rotary body 45 stops at the position corresponding to the indent (click position) of radially undulated portion 52, which is disposed at 40° intervals. As described above, rotary encoder 58 has a click mechanism that enables to stop the rotation of movable contact plate 46.

On the other hand, three flexible conductors 60A, 60B, and 60C are led out from one end (on side 43A-side) of side 53 of frame 43. The conductors 60A, 60B, and 60C have continuity with three fan-shaped conductive layers 47A, 47B, and 47C, respectively. Each tip of conductors 60A, 60B, and 60C is fixed to contact block 61 disposed at lower middle of side 43A.

Figure 12:
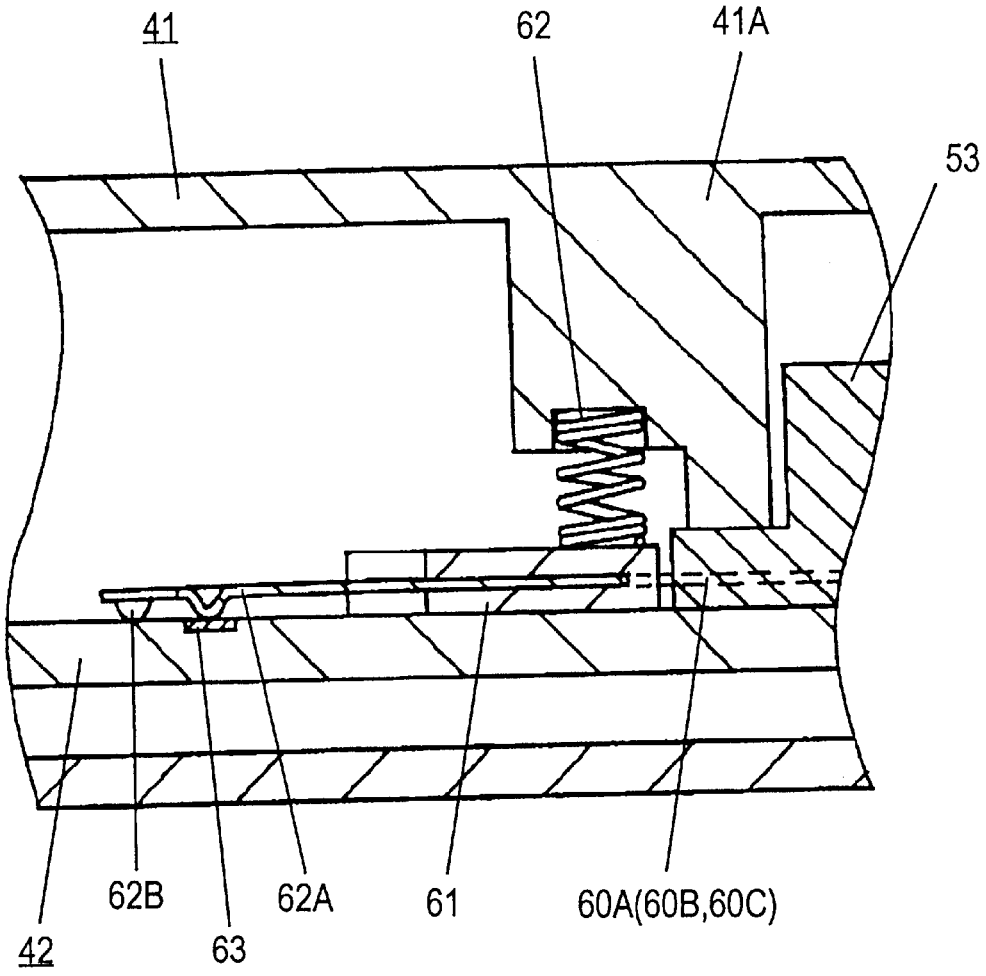
FIG. 12 is a cross-sectional front view of the contact block portion of the RTE shown in FIG. 7.
Figure 13:
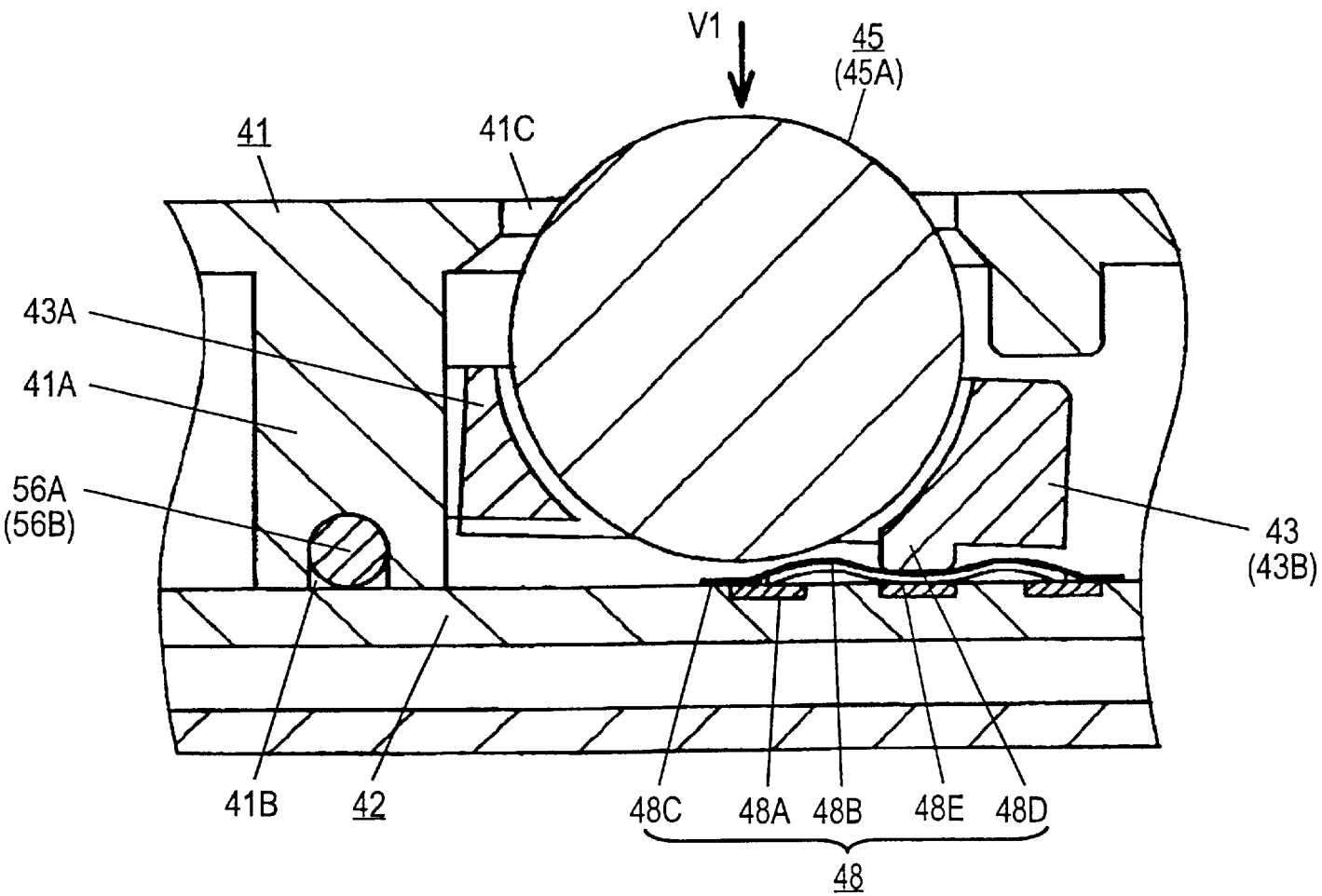
FIG. 13 is a cross-sectional side view depicting the operating state of the PS shown in FIG. 7.
Figure 14:
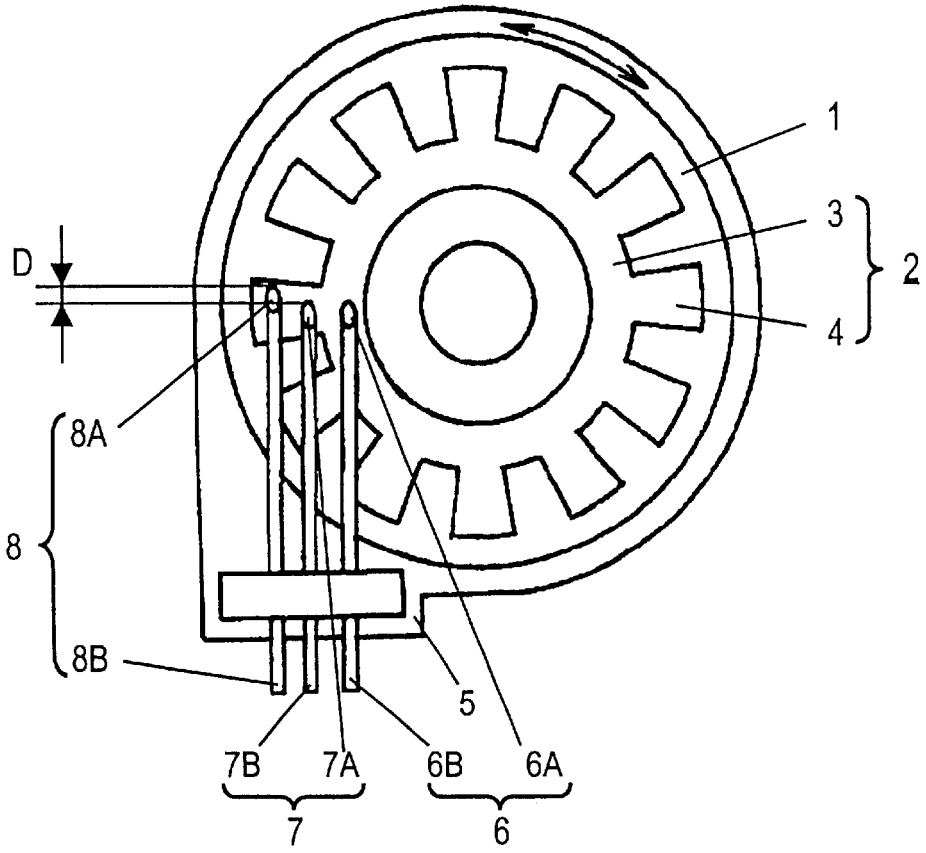
FIG. 14 PRIOR ART
FIG. 14 is a plan view depicting the contact portion of an RTE in the prior art.
Figure 15:
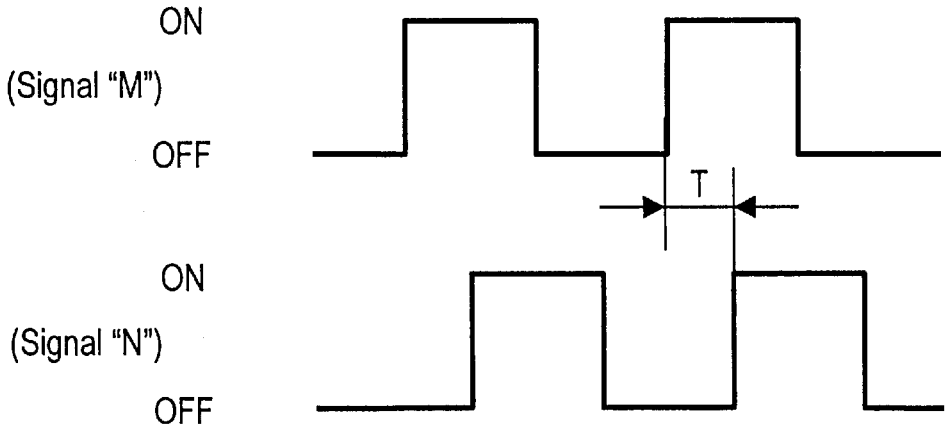
FIG. 15 PRIOR ART
FIG. 15 illustrates waveforms of electric signals generated from the RTE in the prior art.
Figure 16:
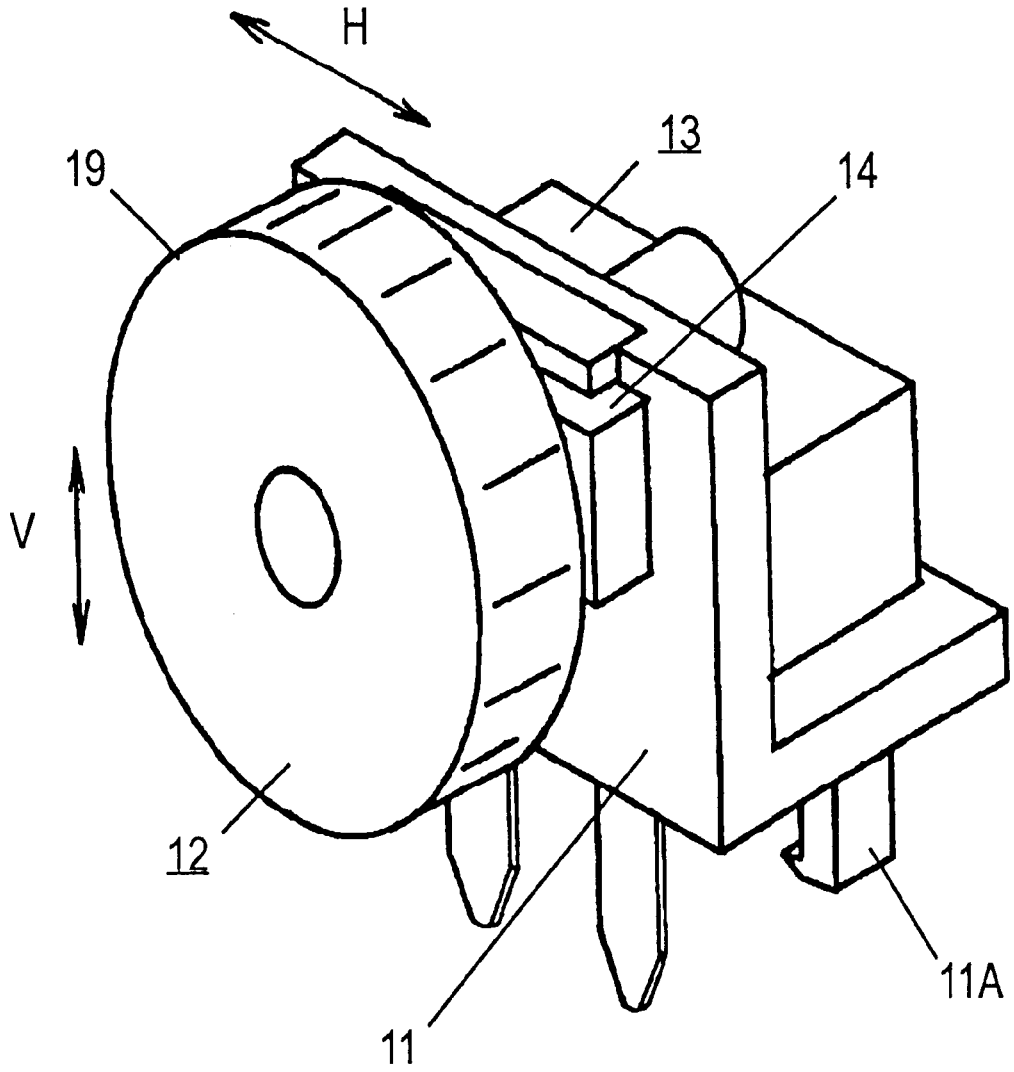
FIG. 16 PRIOR ART
FIG. 16 is a general perspective view of a prior art REPS functioned as a multi-operational electronic component.
Figure 17:
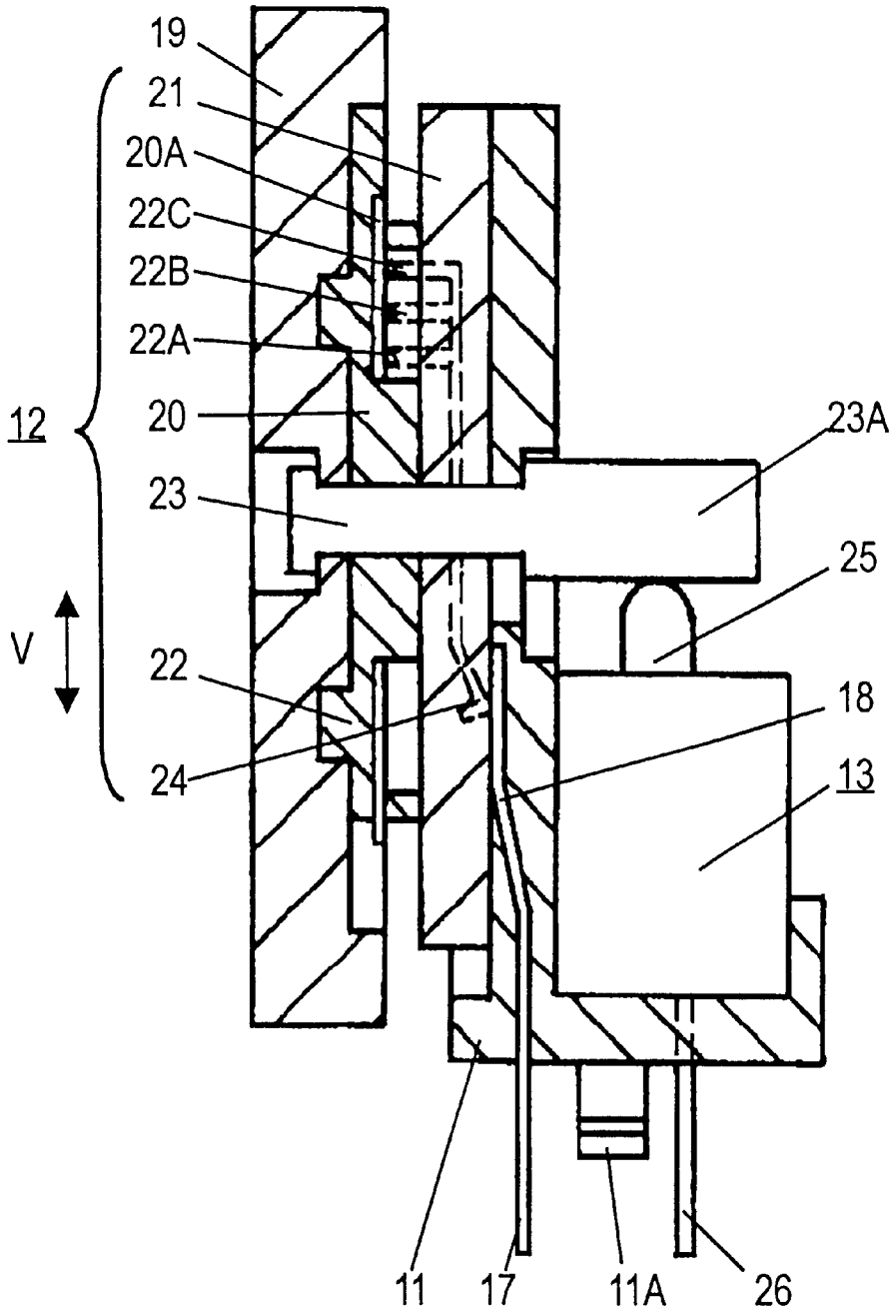
FIG. 17 PRIOR ART
FIG. 17 is a cross-sectional side view of the REPS in the prior art.
Figure 18:
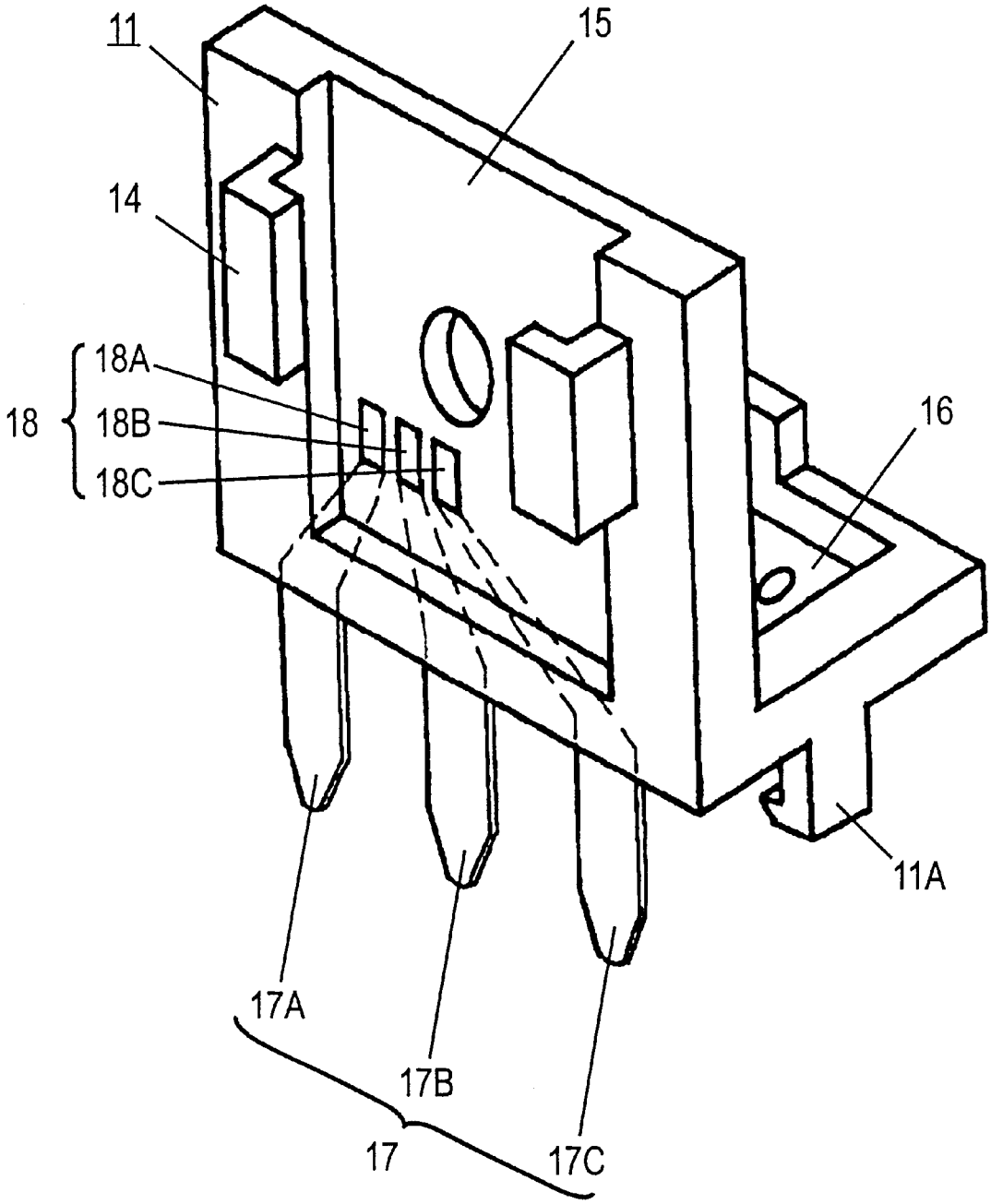
FIG. 18 PRIOR ART
FIG. 18 is a general perspective view depicting a mounting substrate of the RTE in the prior art.
Figure 19:
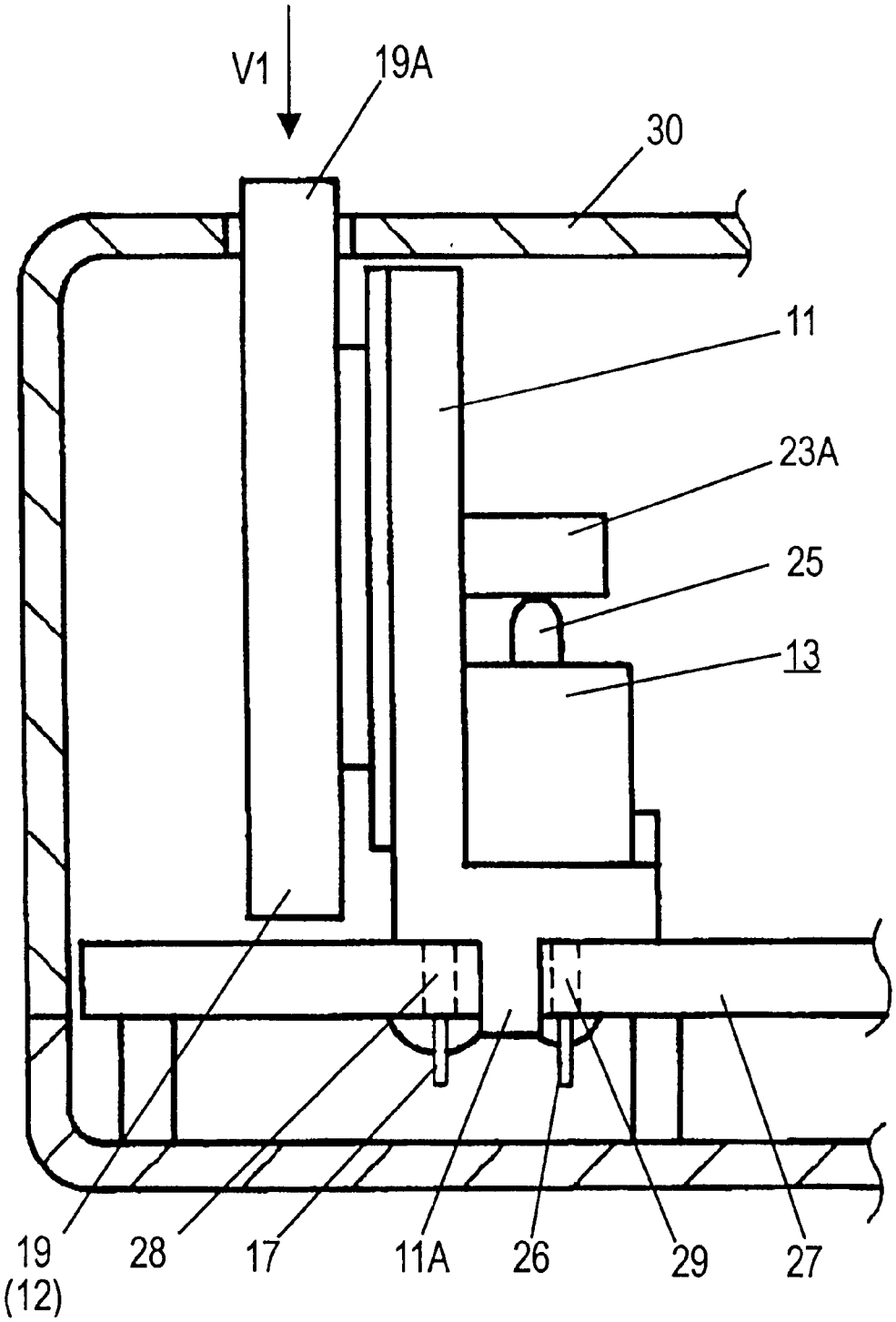
FIG. 19 PRIOR ART
FIG. 19 is a side view, partially in section, of an apparatus equipped with the prior art REPS.

FIG. 12 is a cross-sectional front view of contact block 61. Contact block 61 is, as shown in FIG. 12, fixed to wiring board 42, pressed by flexible body 62 retained by holder 41A that is disposed on upper enclosure 41 of an end-use apparatus. Flexible conductors 60A, 60B, and 60C have continuity with respective three flexible connectors 62A, 62B, and 62C, which are protruded from contact block 61. With such a structure, three flexible connectors 62A, 62B, and 62C have continuity with three contact plates 63 on wiring board 42. In this way, the electric signal generated by RTE 58 can be transmitted to a circuit in the end-use apparatus.

As described above, three flexible conductors 60A, 60B, and 60C are led out from positions close to side 43A that functions as a support axle when frame 43 rotates. Contact block 61 that secures these three conductors is disposed at lower middle of side 43A. This structure minimizes the amount of deflection of flexible conductors 60A, 60B, and 60C when frame 43 rotates. Besides, the REPS including contact block 61 of the embodiment advantageously has a small mounting area on wiring board 42.

As illustrated in FIGS. 9 and 10, self-restoring PS 48 is disposed on wiring board 42 underlying side 43B of frame 43.

PS 48 includes fixed contact 48A, and dome-shaped movable contact 48B disposed on contact 48A. Contact 48A is formed by the conductive layer of wiring board 42, while contact 48B is made of flexible thin metal. The top surface of contact 48B is coated with a flexible insulation film having an adhesive layer on its underneath. Being compact in size, PS 48 is disposed on wiring board 42, keeping in proper alignment with other structuring components.

As illustrated in FIG. 9, pressing projection 48D formed on the bottom surface of side 43B of frame 43 contacts with the top surface of self-restoring PS 48. Pressing projection 48D is biased upwardly by dome-shaped movable contact 48B. The upwardly applied force keeps frame 43 so as to stay in the higher position in its rotation range.

The REPS of this exemplary embodiment constructed as above operates in a manner, which will be described next.

As shown in FIGS. 7 through 9, a portion of periphery 45A of rotary body 45 is protruded from opening 41 of upper enclosure 41 of an end-use apparatus. The protruded portion of periphery 45A is functioned as the operating knob. When a force is applied to periphery 45A in a tangential direction (indicated by the arrow "H" in FIGS. 7 and 9), rotary body 45 rotates in the force-applied direction. As rotary body 45 rotates, three elastic contacts 46A, 46B, and 46C, which are disposed on movable contact plate 46 retained at one end of rotary body 45, resiliently slide on contact substrate 47. Flexible projection 57C of spring 57, which is disposed at the other end of rotary body 45, resiliently slides on radially undulated portion 52. RTE 58 operates as described above.

As described earlier in the RTE of the first preferred embodiment, referring to FIG. 5, projection 57C of spring 57 rests in an indentation that is the click position in radially undulated portion 52. When rotary body 45 is rotated from the state, projection 57C slides on surface 52 by the distance having angular interval of 40°, then settles into the next indentation, accompanying a click feel. Each time projection 57C reaches an indentation (i.e. click position), any two out of three elastic contacts disposed on movable contact plate 46 contact with any two out of three fan-shaped conductive layers. Through the movement, as is the case with RTE of the first preferred embodiment described with FIG. 6, the RTE of the embodiment also generates three different electric signals consecutively. The operating of generating signals is the same as that of the RTE of the first preferred embodiment, the detailed explanation will be omitted.

The electric signal generated by RTE 58 is transmitted to a circuit in an end-use apparatus via the following elements:

1) each of three fan-shaped conductive layers 47A, 47B, and 47C;
2) three flexible conductors 60A, 60B, and 60C;
3) three flexible connectors 62A, 62B, and 62C; and
4) three contact plates 63 disposed on wiring board 42.

As described earlier, side 43B of frame 43 is biased upwardly by PS 48. The upwardly applied force is controlled to a magnitude required to keep frame 43 retaining rotary body 45 still while periphery 45A of rotary body 45 is rotated.

The push switch of the REPS operates in a manner, which will be described hereinafter. FIGS. 7 to 9 show the state in which PS 48 presses upwardly, side 43B of frame 43, which is retaining rotary body 45. Against the upwardly pressed force, a depressing force in a vertical direction (indicated by the arrow "VI" in FIGS. 7 and 9) is applied to periphery 45A of rotary body 45, which functions as an operation knob. Cylindrical holders 56A and 56B disposed on both sides of side 43A are rotatably retained by U-shaped grooves 41B of holders 41A and wiring board 42. Therefore, the depressing force rotates frame 43 around cylindrical holders 56A and 56B. Through this rotation, pressing projection 48D firmly presses the central part of the top surface of dome-shaped movable contact 48B in a downward direction through flexible insulation film 48C. After receiving the depressing force, the central section of movable contact 48B flips its shape over, accompanying a click feel, so that the depressed central part of contact 48B contacts with the middle portion of fixed contact 48E. This brings continuity between fixed switch contact 48A and the middle portion of fixed contact 48E, with the result that PS 48 is switched ON. The switching-ON signal is transmitted to a circuit in the apparatus on wiring board 42.

When removed the depressing force applied to periphery 45A of rotary body 45, dome-shaped movable contact 48B of PS 48 restores its original shape by self restoring characteristics, with PS 48 switched OFF again. Following this, side 43B having pressing projection 48D is pushed back, so that frame 43 returns to the original position placing top position of the rotation range shown in FIG. 9.

When rotating frame 43 by pressing periphery 45A of rotary body 45, a deflection is observed in three flexible conductors 60A, 60B, and 60C. However, as described above, the amount of deflection can be kept to a minimum.

Besides, at this time, i.e., while frame 43 is rotating, flexible projection 57C of spring 57,which is retained at one end of rotary body 45, settles into the indent of radially undulated portion 52 disposed on side 44 of frame 43. Therefore, rotary body 45 does not rotate with respect to frame 43, thereby RTE 58 is kept inactive The REPS of the embodiment described above, employs the RTE with small diameter, which detects the amount of change (rotational angle) and rotating direction based on the number of the three different electric signals generated in rotational operation and its generating order. In other words, the REPS of the embodiment employs a cylindrical operation knob with smaller outer diameter and a lower frame in height, with the enclosure of an end-use apparatus kept a low-profile.

According to the present invention, as described above, it is possible to detect the amount of change (rotational angle) and rotating direction through the number of the three different electric signals generated in rotational operation and its generating order. Besides, as another advantage, the three elastic contacts, which contact resiliently with a contact substrate, are disposed on the positions having a same distance from the center of the substrate. The arrangement realizes the RTE with a small diameter. Therefore, the RTE contributes to obtain an improved multi-operational electronic component having not only the cylindrical operation knob with a smaller diameter, but also the enclosure of the end-use apparatus with a low profile.

What is claimed is:

1. A multi-operational electronic component including a rotary encoder and a self-restoring push switch, said rotary encoder comprising:

a quadrangular frame, said quadrangular frame comprising a first side section, a second side section, a third side section and a fourth side section, said first side section facing said second side section, said third side section facing said fourth side section, said second side section rotatably retaining said quadrangular frame so as to function as a support axis for said quadrangular frame;

a cylindrical rotary body comprising a first end, a second end and a periphery, said periphery being an operating section, said cylindrical rotary body being rotatably retained by said third side section of said quadrangular frame and said fourth side section of said quadrangular frame, said cylindrical rotary body being oriented parallel with said second side section of said quadrangular frame;

a movable contact plate comprising three elastic contacts, said movable contact plate being retained at one of said ends of said cylindrical rotary body;

a contact plate disposed on one of said side sections of said quadrangular frame, said contact plate disposed so as to face said movable contact plate, and three fan-shaped conductive layers disposed on said contact plate, said fan-shaped conductive layers having lead terminals, respectively;

wherein pressing of said first side section rotates said quadrangular frame about said second side section, thereby activating said self-restoring push switch.

2. The multi-operational electronic component as defined in claim 1, wherein said three fan-shaped conductive layers are separated from one another by a radial angle of 60°, and are spaced apart to subtend an angle of 80° at a center of said substrate.

3. The multi-operational electronic component as defined in claim 2, wherein said movable contact plate further comprises a plurality of click positions, wherein each click position of said plurality of said click positions are separated from one another by a rotational angle of 40°.

4. The multi-operational electronic component as defined in claim 3, wherein said three elastic contacts comprise a first elastic contact, a second elastic contact and a third elastic contact;

wherein said three fan-shaped conductive layers comprise a first fan-shaped conductive layer, a second fan-shaped conductive layer and a third fan-shaped conductive layer, and wherein at any time, said first elastic contact is in contact with said first fan-shaped conductive layer and said second elastic contact is in contact with said second fan-shaped conductive layer at one of said plurality of said click positions, said first elastic contact is in contact with said first fan-shaped conductive layer and said third elastic contact is in contact with said third fan-shaped conductive layer at said one of said plurality of said click positions, or said second elastic contact is in contact with said second fan-shaped conductive layer and said third elastic contact is in contact with said third fan-shaped conductive layer at said one of said plurality of said click positions.

5. The multi-operational electronic component as defined in claim 1, wherein said three fan-shaped conductive layers are separated from one another by a rotational angle that is greater that 45° and less than 75°.

6. The multi-operational electronic component as defined in claim 1, further comprising:

an upper enclosure;

a wiring board; and cylindrical holders disposed on said second side section, said cylindrical holder being rotatably retained between an upper enclosure and said wiring board.

7. The multi-operational electronic component as defined in claim 1, further comprising:

an upper enclosure;

a wiring board comprising three contact plates;

three flexible conductors disposed on said three fan-shaped conductive layers, respectively;

an insulating resin contact block, which secures each of three flexible conductors, being fixed between said upper enclosure and said wiring board; and three flexible connectors protruding from said contact block, each of said three flexible connectors being in resilient contact with one of said three contact plates, respectively, on said wiring board.

8. The multi-operational electronic component as defined in claim 7, wherein said contact block is disposed at a lower middle section of said second side section of said quadrangular frame.

9. The multi-operational electronic component as defined in claim 1, further comprising a wiring board, wherein said push switch comprises:

fixed switch contacts comprising a conductive layer on said wiring board, and a dome-shaped movable contact comprising a flexible thin metal, disposed over said fixed switch contacts.

10. The multi-operational electronic component as defined in claim 1, further comprising:

a flexible spring fixed to said first end of said cylindrical rotary body, said flexible spring comprising a resilient contact;

wherein said third side section of said quadrangular frame comprises a radially undulated portion; and wherein said resilient contact of said flexible spring is in contact with said radially undulated portion of said third side section of said quadrangular frame.

11. The multi-operational electronic component as defined in claim 1, wherein said cylindrical rotary body further comprises a recess in said second end, wherein said movable contact plate further comprises a flexible metallic circular flat plate, wherein said flexible metallic circular flat plate comprises:

three identically shaped flexible legs, each of said flexible legs having a tip and a base section, each of said flexible legs being partially stamped-out and propped-up from said circular flat plate;

an elastic contact on each said tip of said legs, respectively; and three cuts formed on a periphery of said flexible metallic circular flat plate, said three cuts being disposed at positions close to each said base section of said three flexible legs, respectively;

wherein said cylindrical rotary body further comprises a recess in said second end, said recess having an inner periphery;

wherein three projections are disposed on said inner periphery of said recess in said second end of said cylindrical rotary body; and wherein said three projections engage with said three cuts on said flexible metallic circular flat plate, respectively.

* * * * *